US007147443B2

(12) United States Patent
Ogawa et al.

(10) Patent No.: US 7,147,443 B2
(45) Date of Patent: Dec. 12, 2006

(54) ELECTRIC COMPRESSOR

(75) Inventors: Nobuaki Ogawa, Shiga (JP); Masahiko Makino, Shiga (JP); Yukihiro Fujiwara, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 11/077,214

(22) Filed: Mar. 11, 2005

(65) Prior Publication Data

US 2005/0201873 A1 Sep. 15, 2005

(30) Foreign Application Priority Data

Mar. 11, 2004 (JP) ..... 2004-068583

(51) Int. Cl.
*F04B 17/03* (2006.01)

(52) U.S. Cl. ..... 417/410.1; 417/366

(58) Field of Classification Search ..... 417/366, 417/410.1, 410.5

See application file for complete search history.

(56) References Cited

U.S. PATENT DOCUMENTS 6,599,104 B1 * 7/2003 Saito et al. ..... 417/366
6,619,933 B1 * 9/2003 Ikeda ..... 417/410.1
6,808,372 B1 * 10/2004 Makino et al. ..... 417/410.5
2004/0109772 A1 * 6/2004 Ogawa et al. ..... 417/410.5

* cited by examiner

*Primary Examiner*—Michael Koczo, Jr.
(74) *Attorney, Agent, or Firm*—Armstrong, Kratz, Quintos, Hanson & Brooks, LLP

(57) ABSTRACT

It is an object of the present invention to provide an electric compressor capable of enhancing the mountability with respect to a vehicle without increasing the compressor in size when the electric compressor and a motor-driving circuit which drives a motor of the electric compressor are integrally formed together. A suction chamber 61 which is in communication with a fixed panel suction port 16 provided in a fixed scroll 11 from a suction port 8 provided in a sub-casing 102, and a discharge chamber 62 which is in communication with a communication passage 63 from a fixed panel discharge port 31 provided in the fixed scroll 11 are disposed on the same plane in a radial direction of a compressor, and the motor-driving circuit 101 is disposed in an axial direction of the compressor so that an IPM 105 which is a heat generating part of the circuit substrate 103 can be brought into tight contact with the suction chamber 61.

7 Claims, 3 Drawing Sheets

ELECTRIC COMPRESSOR

TECHNICAL FIELD

The present invention relates to an electric compressor integrally provided with a motor-driving circuit, and more particularly, to a vehicle-mounted electric compressor.

BACKGROUND TECHNIQUE

In a conventional electric compressor of this kind, a motor-driving circuit is disposed on a body casing in which a compression mechanism and a motor are accommodated (e.g., see patent document 1).

FIG. 3 is a sectional view of a conventional scroll compressor described in the patent document 1. In FIG. 3, an inverter 60 which controls an electric motor is mounted on a radially outer upper surface of a casing 7. The inverter 60 comprises a switching element 62. Among constituent elements of the inverter 60, the switching element 62 generates higher heat. The switching element 62 is supported such that the switching element 62 is pasted on an outer peripheral surface of a cylindrical body 63 in a unit housing 70 in which the inverter 60 is accommodated. The cylindrical body 63 corresponds to a refrigerant passage. A sucked refrigerant can absorb heat from the switching element 62 supported by the cylindrical body 63 and cool the switching element 62. Thus, a radiating member is unnecessary unlike the conventional technique.

[Patent Document 1] Japanese Patent Application Laid-open No. 2002-161859.

However, the conventional structure has a problem that the electric compressor integrally provided with the inverter which drives the electric motor has such an outer shape that the unit housing radially projects from the outer peripheral surface of the substantially cylindrical machine body, the outer shape is distort, and the mountability of the electric compressor on a vehicle is inferior.

The inverter can be disposed in the axial direction, but since the discharge member is formed on a shaft end of the inverter on the side of the compression mechanism, in order to cool a heat-generating part of the inverter, it is necessary to interpose a suction chamber for cooling the heat-generating part between the inverter and the discharge chamber, or to provide some type of radiating member, and this increases the compressor in size and weight.

The present invention has been accomplished to solve such a conventional problem, and it is an object of the invention to provide an electric compressor in which even if the electric compressor is integrally provided with a circuit for driving motor, the mountability of the electric compressor on a vehicle is not deteriorated, and the compressor is not increased in size.

DISCLOSURE OF THE INVENTION

To solve the above problem, a first aspect of the present invention provides an electric compressor in which a compression mechanism which compresses and discharges a refrigerant sucked into a compression chamber, a motor which drives the compression mechanism, and a motor-driving circuit which drives the motor are integrally formed together, wherein a suction chamber which introduces a refrigerant from a suction port into the compression chamber, and a discharge chamber which introduces a sucked refrigerant discharged from the compression chamber into a discharge port are formed on the same plane in a radial direction of the compressor, a heat generating part of the motor-driving circuit is cooled by the sucked refrigerant in the suction chamber.

With this structure, the motor-driving circuit can be disposed in the axial direction without interposing the suction chamber between the motor-driving circuit and the discharge chamber. Therefore, the mountability of the compressor on a vehicle can be enhanced without increasing the size of the compressor.

According to a second aspect of the invention, the motor-driving circuit and the motor are integrally formed together in an axial direction of the compressor, the heat generating part of the motor-driving circuit is brought into thermal contact with the suction chamber. With this structure, although the shape of the electric compressor is slightly increased in the axial direction, the deterioration of the mountability of the compressor on a vehicle is small, a heat generating part of the motor-driving circuit can be disposed in the vicinity of the suction chamber, and the heat generating part can be brought into thermal contact with the suction chamber efficiently.

According to a third aspect of the invention, wherein the suction chamber and the discharge chamber are separated from each other in a casing by means of a division wall and these chambers are integrally formed together. Therefore, it is unnecessary to separately or individually provide the suction chamber and the discharge chamber, the structure can be simplified and can become smaller. Further, the compressor can be produced easily and costs thereof can be reduced.

According to a fourth aspect of the invention, the division wall is provided with a thermal insulation portion which suppresses thermal transfer. Therefore, even if the compression mechanism or the discharge chamber is heated to high temperature by heat caused by the compression effect of the refrigerant, it is possible to prevent the heat from transferring from the discharge chamber toward the suction chamber by the thermal insulating effect. Thus, thermal adverse influence on the heat generating part of the motor-driving circuit is reduced, and the cooling effect of the motor-driving circuit is enhanced.

According to a fifth aspect of the invention, the thermal insulation portion is an air layer. Therefore, the structure is simplified, the compressor can be produced easily, and cost thereof can be reduced.

According to a sixth aspect of the invention, when the electric compressor is mounted on an internal combustion engine of a vehicle, the division wall is formed such that the suction chamber is located on the opposite side from the internal combustion engine. Therefore, extremely serious radiant heat influence from the internal combustion engine on the suction chamber and the heat generating part of the motor-driving circuit can be prevented. As a result, the motor-driving circuit can be cooled more effectively.

According to a seventh aspect of the invention, a wall surface of the suction chamber on the side of the motor-driving circuit is formed with a projection. With this, the heat exchanging effect between the suction chamber and the refrigerant is enhanced. As a result, the heat generating part of the motor-driving circuit can be cooled more effectively.

According to the electric compressor of the present invention, the suction chamber and the discharge chamber are provided on the same plane in the radial direction, and the motor-driving circuit is disposed in the axial direction. With this structure, it is unnecessary to provide the suction chamber, the discharge chamber and the motor-driving circuit in succession in the axial direction. Therefore, there is effect that the problem that the compressor is increased in size and weight can be solved almost completely, and the mountability of the compressor on a vehicle is enhanced. According to the present invention, the suction chamber and the discharge chamber are divided by the division wall and those elements are integrally formed together in the casing. With this structure, there is effect that the structure can be simplified and thus, the compressor can be made smaller, and its cost can be reduced.

According to the invention, the division wall is provided with the thermal insulation portion. With this structure, thermal transfer from the discharge chamber toward the suction chamber can be suppressed by the thermal insulating effect of the thermal insulation portion. Thus, there is effect that the thermal influence on the heat generating part of the motor-driving circuit is reduced and the cooling effect is enhanced.

According to the present invention, the suction chamber and the discharge chamber are formed substantially laterally, and the suction chamber is disposed on the opposite side from the internal combustion engine. With this structure, there is effect that the thermal influence from the internal combustion engine on the heat generating part of the motor-driving circuit can be avoided.

BEST MODE FOR CARRYING OUT THE INVENTION

An embodiment of the present invention will be explained with reference to the drawings. The invention is not limited by the embodiment.

Figure 1:
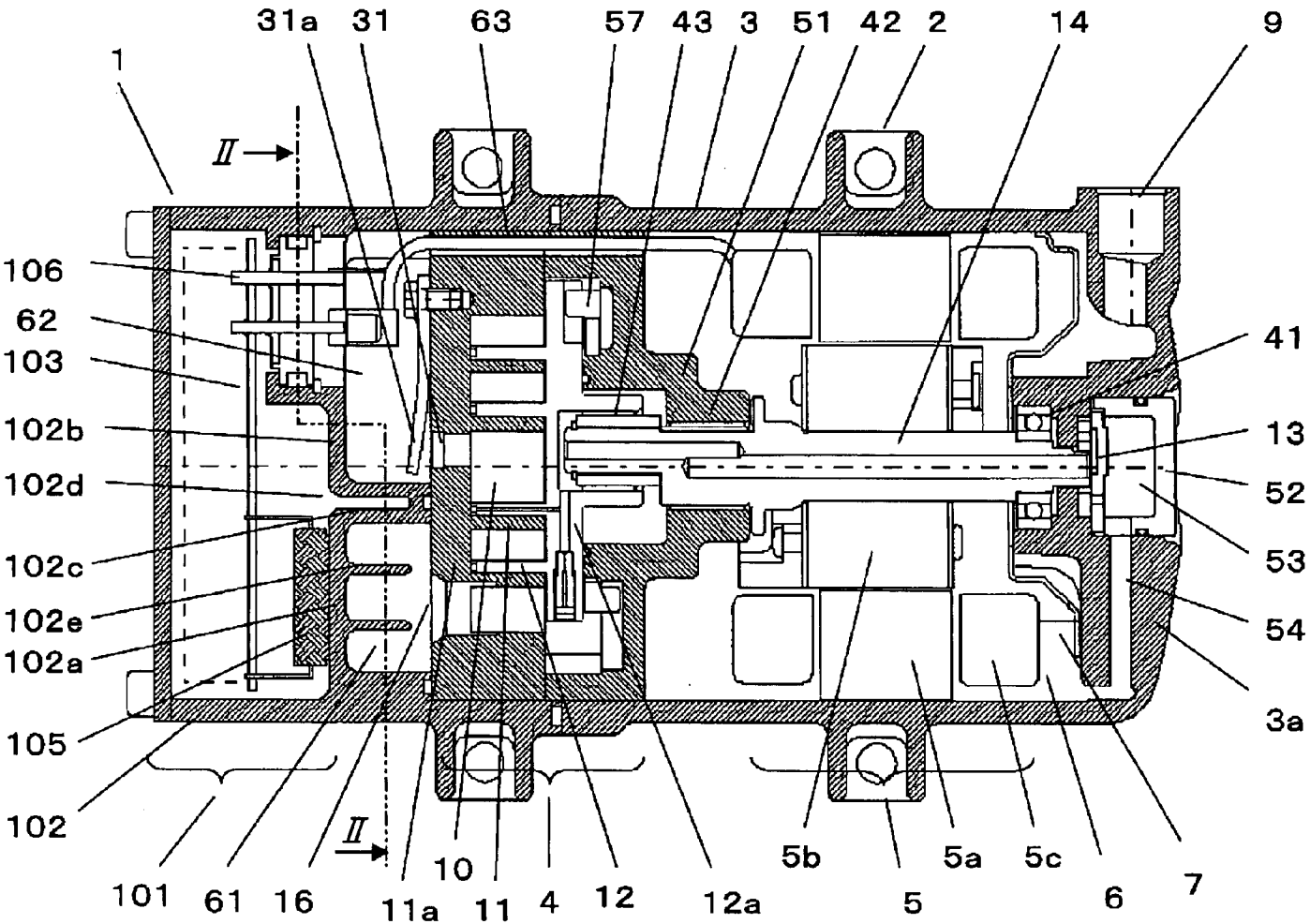
FIG. 1 is a sectional view of an electric compressor according to an embodiment of the present invention.
Figure 2:
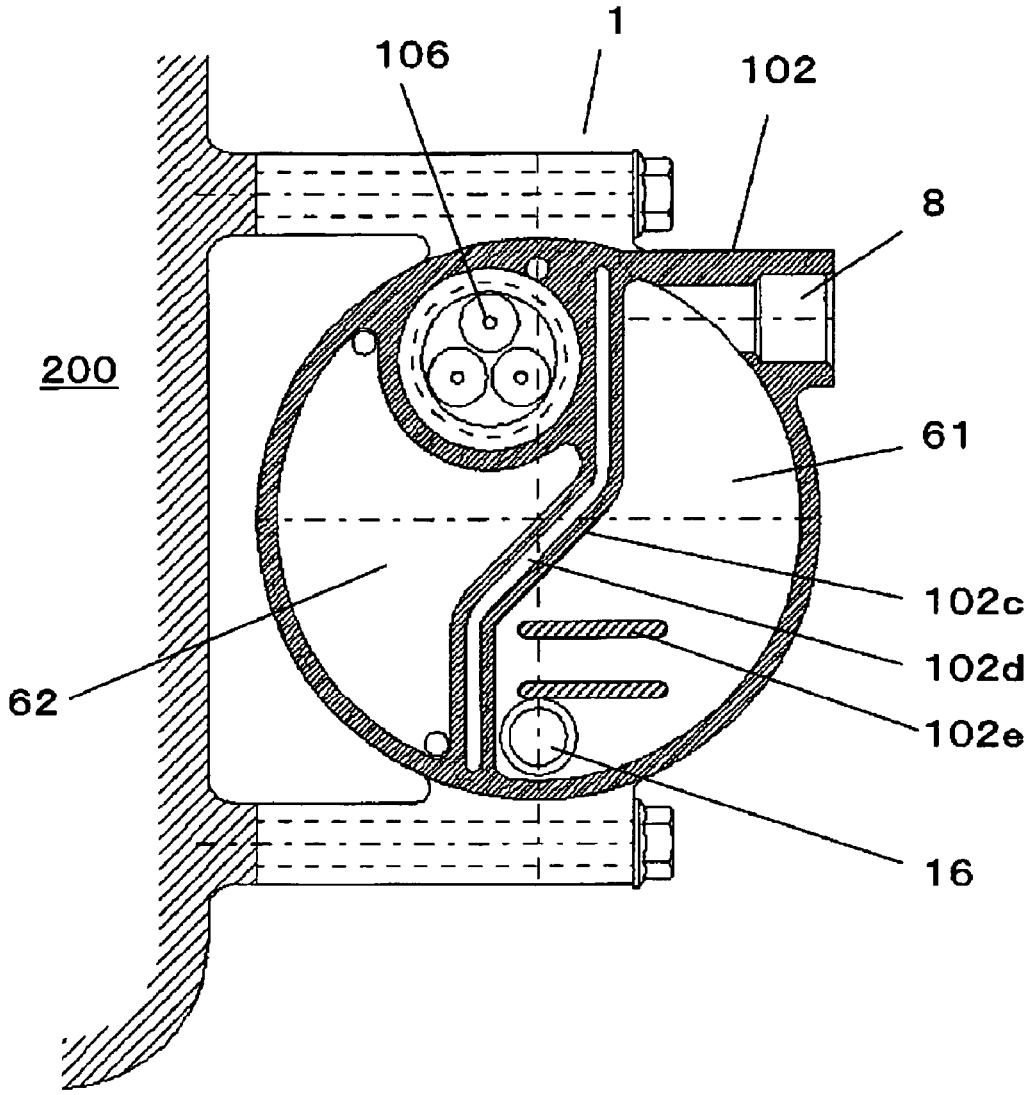
FIG. 2 is a sectional view taken along the line A—A in FIG. 1.
Figure 3:
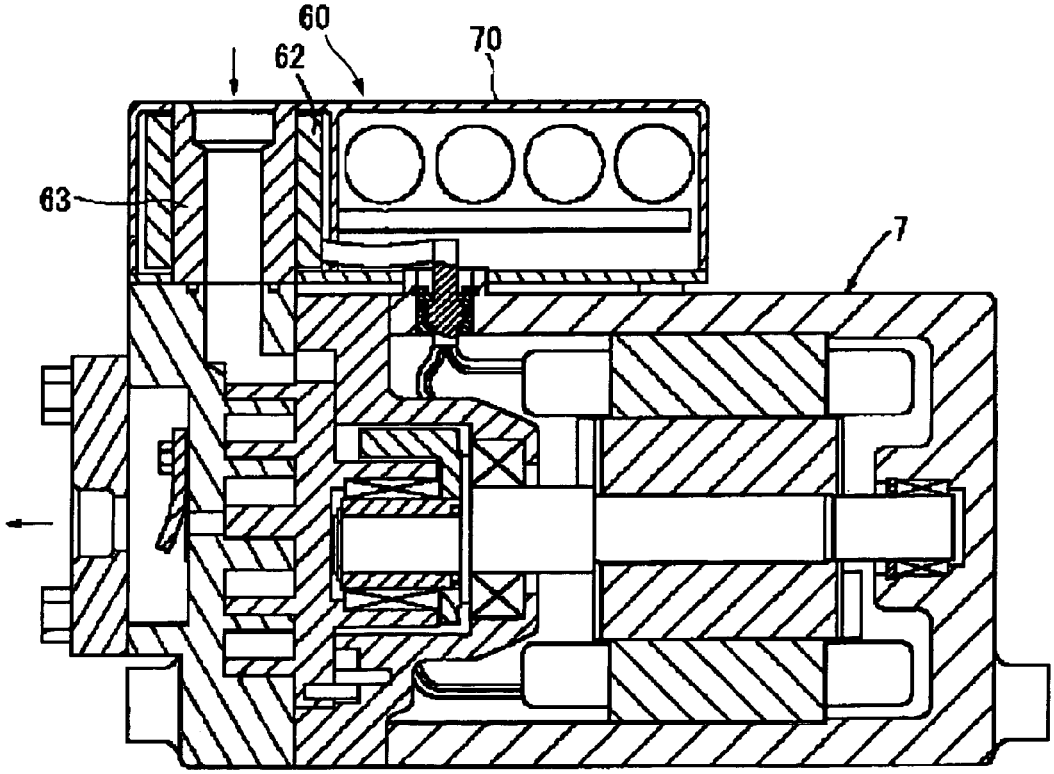
Fig. 3 PRIOR ART
FIG. 3 is a sectional view of a conventional scroll compressor.

FIG. 1 is a sectional view of an electric compressor according to an embodiment of the present invention, and FIG. 2 is a sectional view taken along the line A—A in FIG. 1.

FIGS. 1 and 2 show one example of a lateral type electric compressor 1 which is disposed laterally on a side surface of an internal combustion engine 200 of a vehicle by mounting legs 2. The electric compressor 1 has a body casing 3 in which a compression mechanism 4 and a motor 5 for driving the compression mechanism 4 are accommodated. The electric compressor 1 also includes a liquid reservoir 6 in which liquid used for lubricating various sliding portions including the compression mechanism 4 is stored. The motor 5 is driven by a motor-driving circuit 101. A refrigerant used here is a gas refrigerant. Liquid such as lubricant oil 7 is used for lubricating the various sliding portions and for sealing the sliding portions of the compression mechanism 4.

The compression mechanism 4 of the electric compressor 1 of this embodiment is of a scroll type. In the compression mechanism 4, a fixed scroll 11 and an orbiting scroll 12 are meshed with each other to form a compression space 10, and when the orbiting scroll 12 orbits with respect to the fixed scroll 11 by the motor 5 through a drive shaft 14, a capacity of the compression space 10 is varied by this orbiting motion, and a refrigerant is sucked from a fixed panel suction port 16 and is discharged from a fixed panel discharge port 31. The refrigerant which returns from an external cycle comprising a heat exchanger and the like is sucked from a suction port 8 formed in a sub-casing 102, and a compressed refrigerant is discharged into the external cycle through a discharge port 9 formed in the body casing 3.

A pump 13 for supplying lubricant oil 7, an auxiliary bearing 41, a motor 5, a main bearing 42 and a main bearing member 51 for holding the main bearing 42 are accommodated in the body casing 3 in this order from the side of an end wall 3*a* of the body casing 3. The pump 13 is accommodated in the body casing 3 from an outer surface of the end wall 3*a* and then, the pump 13 is held between the end wall 3*a* and a lid 52 which is thereafter fitted to the end wall 3*a*. A pump chamber 53 which is in communication with the liquid reservoir 6 through a suction passage 54 is formed inside of the lid 52. The auxiliary bearing 41 is held by the end wall 3*a*. The auxiliary bearing 41 pivotally supports a side of the drive shaft 14 which is connected to the pump 13.

A stator 5*a* of the motor 5 is fixed to an inner periphery of the body casing 3 by shrinkage fit. A rotor 5*b* of the motor 5 is fixed to an intermediate portion of the drive shaft 14. The drive shaft 14 can be rotated by the stator 5*a* and the rotor 5*b*.

The main bearing member 51 is fixed to an inner periphery of the body casing 3 by shrinkage fit. A side of the drive shaft 14 closer to the compression mechanism 4 is pivotally supported by the main bearing 42.

The fixed scroll 11 is mounted on an outer surface of the main bearing member 51 by means of a bolt (not shown), the orbiting scroll 12 is sandwiched between the main bearing member 51 and the fixed scroll 11, thereby constituting the scroll compressor. A rotation-suppressing member 57 such as an Oldham ring is provided between the main bearing member 51 and the orbiting scroll 12. The rotation-suppressing member 57 prevents the rotation of the orbiting scroll 12 but allows the revolution of the orbiting scroll 12. The drive shaft 14 is connected to the orbiting scroll 12 through an eccentric bearing 43 so that the orbiting scroll 12 can revolve on a circular orbit.

A portion of the compression mechanism 4 which is exposed from the body casing 3 is covered with the sub-casing 102. An opening side of the body casing 3 and an opening side of the sub-casing 102 are abutted against each other, and they are fixed to each other through a bolt or the like (not shown). The sub-casing 102 comprises end walls 102*a* and 102*b* extending from a central portion in the body casing 3 in the radial direction of the body casing 3. The end walls 102*a* and 102*b* are divided substantially laterally by a division wall 102*c* having a substantially U-shaped cross section. The division wall 102*c* is formed such that it comes into tight contact with the fixed scroll 11 when the compressor is assembled. A suction chamber 61 is formed on the side of the end wall 102*a*, and a discharge chamber 62 is formed on the side of the end wall 102*b*. The division wall 102*c* has the substantially U-shaped cross section to form a thermal insulation portion 102*d*, and thermal transmission between a suction chamber 61 and a discharge chamber 62 is suppressed by the division wall 102*c*.

The compression mechanism 4 is located between the suction port 8 formed in the sub-casing 102 and the discharge port 9 of the body casing 3. The fixed panel suction port 16 is connected to the suction port 8 of the sub-casing 102 through the suction chamber 61. The fixed panel discharge port 31 is in communication with the discharge chamber 62 through a lead valve 31*a*. The discharge chamber 62 is in communication with a space of the body casing 3 closer to the motor 5 having the discharge port 9 through a communication passage 63 formed between the fixed scroll 11 and the main bearing member 51, or between those and the body casing 3.

The motor-driving circuit 101 is formed in the axial direction of the compressor. In the motor-driving circuit 101, a circuit substrate 103 and an electrolytic capacitor (not shown) are accommodated on the opposite side from the suction chamber 61 and the discharge chamber 62 with respect to the end walls 102*a* and 102*b*.

An intelligent power module (IPM, thereinafter) 105 is mounted on the circuit substrate 103. The IPM 105 includes a switching element generating high temperature. The IPM 105 is a high temperature generating portion of the motor-driving circuit 101. The IPM 105 is brought into contact with the end wall 102*a* which forms the suction chamber 61 so that the IPM 105 is thermally in tight contact with the end wall 102*a*. A fin 102*e* is formed on the side of the end wall 102*a* closer to the refrigerant, thereby enhancing the heat exchanging effect.

The motor-driving circuit 101 is electrically connected to a winding 5*c* of the motor 5 through a compressor terminal 106. The motor 5 can be operated in a state in which an operator monitors necessary information such as temperature. The motor-driving circuit 101 is provided with a harness connector (not shown) which can electrically be connected to an external element.

With the above-described structure, the motor 5 is driven by the motor-driving circuit 101, the compression mechanism 4 is orbited by the drive shaft 14, and a low temperature refrigerant from a refrigeration cycle is sucked through the suction port 8 of the sub-casing 102, the suction chamber 61 and the fixed panel suction port 16 formed in the fixed scroll 11. At that time, the low temperature refrigerant cools a fin 102*e* and the end wall 102*a* of the suction chamber 61, and the end wall 102*a* cools the IPM 105.

In this embodiment, the basic structure is that the suction chamber 61 which is in communication with the fixed panel suction port 16 provided in the fixed scroll 11 from the suction port 8 provided in the sub-casing 102, and the discharge chamber 62 which is in communication with the communication passage 63 from the fixed panel discharge port 31 provided in the fixed scroll 11 are disposed on the same plane in the radial direction.

With this structure, it is unnecessary to provide the suction chamber 61 or other radiating member for cooling the motor-driving circuit 101 between the discharge chamber 62 and the motor-driving circuit 101 in the axial direction. Thus, the compressor is not increased in size in the axial direction, and the mountability of the compressor on a vehicle can be enhanced. The high temperature generating part such as the IPM 105 of the motor-driving circuit 101 is disposed on the side of the suction chamber 61 and is brought into thermally tight contact therewith, the high temperature generating part can efficiently be cooled by the low temperature sucked refrigerant.

The suction chamber 61 and the discharge chamber 62 are integrally formed together such that the division wall 102*c* is provided therebetween on the side of the fixed scroll 11 of the sub-casing 102. Therefore, it is unnecessary to separately or individually provide the suction chamber 61 and the discharge chamber 62, and the structure can be simplified and can become smaller. Further, the compressor can be produced easily and costs thereof can be reduced.

The division wall 102*c* of the sub-casing 102 is provided with the thermal insulation portion 102*d* which suppress the thermal transfer. Therefore, even if the compression mechanism 4 or the discharge chamber 62 is heated to high temperature by heat caused by the compression effect of the refrigerant, it is possible to prevent the heat from transferring from the discharge chamber 62 toward the suction chamber 61 by the thermal insulating effect of the thermal insulation portion. Thus, thermal adverse influence on the heat generating part of the motor-driving circuit 101 is reduced, and the cooling effect of the motor-driving circuit 101 is enhanced.

If the thermal insulation portion 102*d* is an air layer, the structure is further simplified, and the cost of the compressor is reduced.

As shown in FIG. 2, the division wall 102*c* is formed such that the suction chamber 61 and the discharge chamber 62 are separated substantially laterally, and the electric compressor 1 is mounted on the internal combustion engine 200. If the suction chamber 61 is located on the opposite side from the internal combustion engine 200, extremely serious radiant heat influence from the internal combustion engine 200 on the suction chamber 61 and the heat generating part of the motor-driving circuit 101 can be prevented. As a result, the motor-driving circuit 101 can be cooled more effectively.

The invention claimed is:

1. An electric compressor in which a compression mechanism which compresses and discharges a refrigerant sucked into a compression chamber, a motor which drives said compression mechanism, and a motor-driving circuit which drives said motor are integrally formed together, wherein a suction chamber which introduces a refrigerant from a suction port into said compression chamber, and a discharge chamber which introduces refrigerant discharged from said compression chamber into a discharge port are formed on the same plane in a radial direction of said compressor relative to the rotational axis of the compressor, a heat generating part of said motor-driving circuit is cooled by the refrigerant in said suction chamber.

2. The electric compressor according to claim 1, wherein said motor-driving circuit and said motor are integrally formed together in an axial direction of said compressor, said heat generating part of said motor-driving circuit is brought into thermal contact with said suction chamber.

3. The electric compressor according to claim 1 or 2, wherein said suction chamber and said discharge chamber are separated from each other in a casing by means of a division wall and these chambers are integrally formed together.

4. The electric compressor according to claim 3, wherein said division wall is provided with a thermal insulation portion which suppresses thermal transfer.

5. The electric compressor according to claim 4, wherein said thermal insulation portion is an air layer.

6. The electric compressor according to claim 1, wherein said electric compressor is mounted on an internal combustion engine of a vehicle, said division wall is formed such that said suction chamber is located on the opposite side from said internal combustion engine.

7. The electric compressor according to claim 1, wherein a wall surface of said suction chamber on the side of said motor-driving circuit is formed with a fin.

* * * * *